US007898485B2

(12) United States Patent
Schlub et al.

(10) Patent No.: US 7,898,485 B2
(45) Date of Patent: Mar. 1, 2011

(54) HANDHELD ELECTRONIC DEVICES WITH ISOLATED ANTENNAS

(75) Inventors: Robert W. Schlub, Campbell, CA (US); Robert J. Hill, Salinas, CA (US); Juan Zavala, Watsonville, CA (US); Ruben Caballero, San Jose, CA (US)

(73) Assignee: Apple Inc., Cupertino, CA (US)

( * ) Notice: Subject to any disclaimer, the term of this patent is extended or adjusted under 35 U.S.C. 154(b) by 21 days.

(21) Appl. No.: 12/504,443

(22) Filed: Jul. 16, 2009

(65) Prior Publication Data

US 2009/0278753 A1 Nov. 12, 2009

Related U.S. Application Data

(62) Division of application No. 11/650,071, filed on Jan. 4, 2007, now Pat. No. 7,595,759.

(51) Int. Cl.
*H01Q 1/24* (2006.01)

(52) U.S. Cl. ..... 343/702; 343/700 MS

(58) Field of Classification Search ..... 343/700 MS, 343/702, 725, 767, 846
See application file for complete search history.

(56) References Cited

U.S. PATENT DOCUMENTS

| | | | | |
|---|---|---|---|---|
| 2,947,987 | A * | 8/1960 | Dodington | 343/705 |
| 4,641,366 | A * | 2/1987 | Yokoyama et al. | 455/73 |
| 6,384,696 | B1 | 5/2002 | Miller et al. | |
| 6,624,789 | B1 * | 9/2003 | Kangasvieri et al. | 343/702 |
| 6,670,923 | B1 | 12/2003 | Kadambi et al. | |
| 6,741,214 | B1 | 5/2004 | Kadambi et al. | |
| 6,747,601 | B2 | 6/2004 | Boyle | |
| 6,856,294 | B2 | 2/2005 | Kadambi et al. | |
| 6,980,154 | B2 | 12/2005 | Vance et al. | |
| 7,027,838 | B2 | 4/2006 | Zhou et al. | |
| 7,116,276 | B2 | 10/2006 | Lee | |
| 7,119,747 | B2 | 10/2006 | Lin et al. | |
| 7,202,826 | B2 * | 4/2007 | Grant et al. | 343/713 |
| 7,289,068 | B2 * | 10/2007 | Fujio et al. | 343/700 MS |
| 7,403,164 | B2 | 7/2008 | Sanz et al. | |
| 7,535,422 | B2 * | 5/2009 | Liu et al. | 343/702 |
| 2003/0107518 | A1 | 6/2003 | Li et al. | |
| 2003/0119457 | A1 | 6/2003 | Standke | |
| 2004/0017318 | A1 | 1/2004 | Annabi et al. | |
| 2004/0137950 | A1 | 7/2004 | Bolin et al. | |

(Continued)

FOREIGN PATENT DOCUMENTS

EP 1 315 238 A 7/2003

(Continued)

*Primary Examiner* — Tho G Phan
(74) *Attorney, Agent, or Firm* — Treyz Law Group; G. Victor Treyz; David C. Kellogg

(57) ABSTRACT

Handheld electronic devices are provided that contain wireless communications circuitry having at least first and second antennas. An antenna isolation element reduces signal interference between the antennas, so that the antennas may be used in close proximity to each other. A planar ground element may be used as a ground by the first and second antennas. The first antenna may be formed using a hybrid planar-inverted-F and slot arrangement in which a planar resonating element is located above a rectangular slot in the planar ground element. The second antenna may be formed from an L-shaped strip. The planar resonating element of the first antenna may have first and second arms. The first arm may resonate at a common frequency with the second antenna and may serve as the isolation element. The second arm may resonate at approximately the same frequency as the slot portion of the hybrid antenna.

10 Claims, 12 Drawing Sheets

U.S. PATENT DOCUMENTS

| | | | |
|---|---|---|---|
| 2004/0145521 | A1 | 7/2004 | Hebron et al. |
| 2006/0038736 | A1 | 2/2006 | Hui et al. |
| 2006/0055606 | A1 | 3/2006 | Boyle |
| 2008/0231521 | A1 | 9/2008 | Anguera Pros et al. |

FOREIGN PATENT DOCUMENTS

| | | | |
|---|---|---|---|
| EP | 1 351 334 | | 10/2003 |
| EP | 1 401 050 | | 3/2004 |
| WO | 02/078123 | A | 10/2002 |
| WO | 2004/001894 | | 12/2003 |
| WO | 2004/038857 | A | 5/2004 |
| WO | 2005/019567 | | 11/2005 |
| WO | 2006/114771 | A | 11/2006 |

* cited by examiner

HANDHELD ELECTRONIC DEVICES WITH ISOLATED ANTENNAS

This application is a division of patent application Ser. No. 11/650,071, filed Jan. 4, 2007 now U.S. Pat. No. 7,595,759, which is hereby incorporated by reference herein in its entirety.

BACKGROUND

This invention relates generally to wireless communications circuitry, and more particularly, to wireless communications circuitry for handheld electronic devices.

Handheld electronic devices are becoming increasingly popular. Examples of handheld devices include handheld computers, cellular telephones, media players, and hybrid devices that include the functionality of multiple devices of this type.

Due in part to their mobile nature, handheld electronic devices are often provided with wireless communications capabilities. Handheld electronic devices may use wireless communications to communicate with wireless base stations. For example, cellular telephones may communicate using cellular telephone bands at 850 MHz, 900 MHz, 1800 MHz, and 1900 MHz (e.g., the main Global System for Mobile Communications or GSM cellular telephone bands). Handheld electronic devices may also use other types of communications links. For example, handheld electronic devices may communicate using the WiFi® (IEEE 802.11) band at 2.4 GHz and the Bluetooth® band at 2.4 GHz.

To satisfy consumer demand for small form factor wireless devices, manufacturers are continually striving to reduce the size of components that are used in these devices. For example, manufacturers have made attempts to miniaturize the antennas used in handheld electronic devices.

A typical antenna may be fabricated by patterning a metal layer on a circuit board substrate or may be formed from a sheet of thin metal using a foil stamping process. Many devices use planar inverted-F antennas (PIFAs). Planar inverted-F antennas are formed by locating a planar resonating element above a ground plane. These techniques can be used to produce antennas that fit within the tight confines of a compact handheld device.

To provide sufficient wireless coverage over all communications bands of interest, modern handheld electronic devices sometimes contain multiple antennas. For example, a modern handheld electronic device might have one antenna for handling cellular telephone communications in cellular telephone bands and another antenna for handling data communications in a data communications band. Although the operating frequencies of the cellular telephone antenna and the data communications antenna are different, there will still generally be a tendency for undesirable electromagnetic coupling between the antennas.

This electromagnetic coupling forms an undesirable type of signal interference. Unless the antennas are sufficiently isolated from each other, simultaneous antenna operation will not be possible.

Electromagnetic isolation between two antennas can often be obtained by placing the antennas as far apart as possible within the confines of the handheld electronic device. However, conventional spatial separation arrangements such as these are not always feasible. In some designs, layout constraints prevent the use of spatial separation for reducing antenna interference.

It would therefore be desirable to be able to provide improved ways in which to isolate antennas from each other in a handheld electronic device.

SUMMARY

In accordance with an embodiment of the present invention, a handheld electronic device with wireless communications circuitry is provided. The handheld electronic device may have cellular telephone, music player, or handheld computer functionality. The wireless communications circuitry may have at least first and second antennas.

The first and second antennas may be located in close proximity to each other within the handheld electronic device. With one suitable arrangement, the first antenna is a hybrid planar-inverted-F and slot antenna and the second antenna is an L-shaped strip antenna. The first and second antennas may have respective first and second planar resonating elements. The first and second planar resonating elements may be formed on a flex circuit that is mounted to a dielectric support structure.

A rectangular ground plane element may serve as ground for the first and second antennas. The handheld electronic device may have a metal housing portion that is shorted to ground and may have a plastic cap portion that covers the first and second planar resonating elements.

The rectangular ground plane element may contain a rectangular dielectric-filled slot. The planar resonating elements may be located above the slot. The first planar resonating element may have two arms. A first of the two arms may be tuned to resonate at approximately the same frequency band as the second antenna. When the first and second antennas are operated simultaneously, the first arm serves to cancel interference from the second antenna and thereby serves as an antenna isolation element that helps to isolate the first and second antennas from each other. A second of the two arms may be configured to resonate at the same frequency as the slot portion of the first antenna to enhance the gain and bandwidth of the first antenna at that frequency.

Further features of the invention, its nature and various advantages will be more apparent from the accompanying drawings and the following detailed description of the preferred embodiments.

DETAILED DESCRIPTION

The present invention relates generally to wireless communications, and more particularly, to wireless electronic devices and antennas for wireless electronic devices.

The antennas may be small form factor antennas that exhibit wide bandwidths and large gains.

The wireless electronic devices may be portable electronic devices such as laptop computers or small portable computers of the type that are sometimes referred to as ultraportables. Portable electronic devices may also be somewhat smaller devices. Examples of smaller portable electronic devices include wrist-watch devices, pendant devices, headphone and earpiece devices, and other wearable and miniature devices.

With one suitable arrangement, the portable electronic devices are handheld electronic devices. Space is at a premium in handheld electronics devices, so high-performance compact antennas can be particularly advantageous in such devices. The use of handheld devices is therefore generally described herein as an example, although any suitable electronic device may be used with the antennas of the invention if desired.

The handheld devices may be, for example, cellular telephones, media players with wireless communications capabilities, handheld computers (also sometimes called personal digital assistants), remote controllers, global positioning system (GPS) devices, and handheld gaming devices. The handheld devices may also be hybrid devices that combine the functionality of multiple conventional devices. Examples of hybrid handheld devices include a cellular telephone that includes media player functionality, a gaming device that includes a wireless communications capability, a cellular telephone that includes game and email functions, and a handheld device that receives email, supports mobile telephone calls, and supports web browsing. These are merely illustrative examples.

Figure 1:
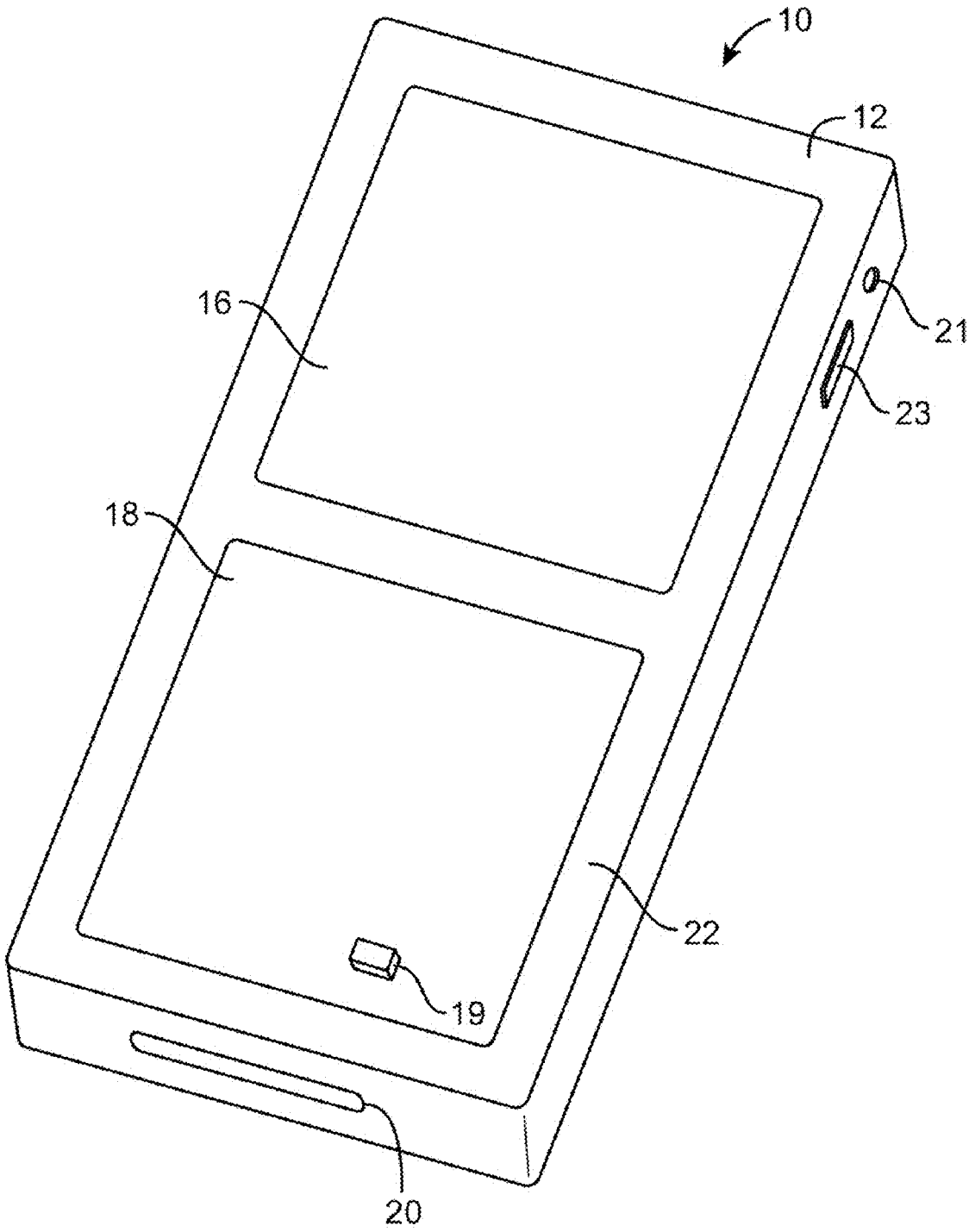
FIG. 1 is a perspective view of an illustrative handheld electronic device with an antenna in accordance with an embodiment of the present invention.

An illustrative handheld electronic device in accordance with an embodiment of the present invention is shown in FIG. 1. Device 10 may be any suitable portable or handheld electronic device.

Device 10 includes housing 12 and includes two or more antennas for handling wireless communications. Embodiments of device 10 that contain two antennas are described herein as an example.

Each of the two antennas in device 10 may handle communications over a respective communications band or group of communications bands. For example, a first of the two antennas may be used to handle cellular telephone frequency bands. A second of the two antennas may be used to handle data communications in a separate communications band. With one suitable arrangement, which is sometimes described herein as an example, the second antenna is configured to handle data communications in a communications band centered at 2.4 GHz (e.g., WiFi and/or Bluetooth frequencies). The design of the antennas helps to reduce interference and allows the two antennas to operate in relatively close proximity to each other.

Housing 12, which is sometimes referred to as a case, may be formed of any suitable materials including, plastic, glass, ceramics, metal, or other suitable materials, or a combination of these materials. In some situations, case 12 may be formed from a dielectric or other low-conductivity material, so that the operation of conductive antenna elements that are located in proximity to case 12 is not disrupted. In other situations, case 12 may be formed from metal elements. In scenarios in which case 12 is formed from metal elements, one or more of the metal elements may be used as part of the antennas in device 10. For example, metal portions of case 12 may be shorted to an internal ground plane in device 10 to create a larger ground plane element for that device 10.

Handheld electronic device 10 may have input-output devices such as a display screen 16, buttons such as button 23, user input control devices 18 such as button 19, and input-output components such as port 20 and input-output jack 21. Display screen 16 may be, for example, a liquid crystal display (LCD), an organic light-emitting diode (OLED) display, a plasma display, or multiple displays that use one or more different display technologies. As shown in the example of FIG. 1, display screens such as display screen 16 can be mounted on front face 22 of handheld electronic device 10. If desired, displays such as display 16 can be mounted on the rear face of handheld electronic device 10, on a side of device 10, on a flip-up portion of device 10 that is attached to a main body portion of device 10 by a hinge (for example), or using any other suitable mounting arrangement.

A user of handheld device 10 may supply input commands using user input interface 18. User input interface 18 may include buttons (e.g., alphanumeric keys, power on-off, power-on, power-off, and other specialized buttons, etc.), a touch pad, pointing stick, or other cursor control device, a touch screen (e.g., a touch screen implemented as part of screen 16), or any other suitable interface for controlling device 10. Although shown schematically as being formed on the top face 22 of handheld electronic device 10 in the example of FIG. 1, user input interface 18 may generally be formed on any suitable portion of handheld electronic device 10. For example, a button such as button 23 (which may be considered to be part of input interface 18) or other user interface control may be formed on the side of handheld electronic device 10. Buttons and other user interface controls can also be located on the top face, rear face, or other portion of device 10. If desired, device 10 can be controlled remotely (e.g., using an infrared remote control, a radio-frequency remote control such as a Bluetooth remote control, etc.).

Handheld device 10 may have ports such as bus connector 20 and jack 21 that allow device 10 to interface with external components. Typical ports include power jacks to recharge a battery within device 10 or to operate device 10 from a direct current (DC) power supply, data ports to exchange data with external components such as a personal computer or peripheral, audio-visual jacks to drive headphones, a monitor, or other external audio-video equipment, etc. The functions of some or all of these devices and the internal circuitry of handheld electronic device 10 can be controlled using input interface 18.

Components such as display 16 and user input interface 18 may cover most of the available surface area on the front face 22 of device 10 (as shown in the example of FIG. 1) or may occupy only a small portion of the front face 22. Because electronic components such as display 16 often contain large amounts of metal (e.g., as radio-frequency shielding), the location of these components relative to the antenna elements in device 10 should generally be taken into consideration. Suitably chosen locations for the antenna elements and electronic components of the device will allow the antennas of handheld electronic device 10 to function properly without being disrupted by the electronic components.

With one suitable arrangement, the antennas of device 10 are located in the lower end of device 10, in the proximity of port 20. An advantage of locating antennas in the lower portion of housing 12 and device 10 is that this places the antennas away from the user's head when the device 10 is held to the head (e.g., when talking into a microphone and listening to a speaker in the handheld device as with a cellular telephone). This reduces the amount of radio-frequency radiation that is emitted in the vicinity of the user and minimizes proximity effects. However, locating both of the antennas at the same end of device 10 raises the possibility of undesirable interference between the antennas when the antennas are in simultaneous operation. To improve isolation to a satisfactory level, at least one of the antennas may be provided with an isolation element that reduces electromagnetic coupling between the antennas. By reducing electromagnetic coupling in this way, the antennas may be placed in relatively close proximity to each other without hindering the ability of the antennas to be operated simultaneously.

Figure 2:
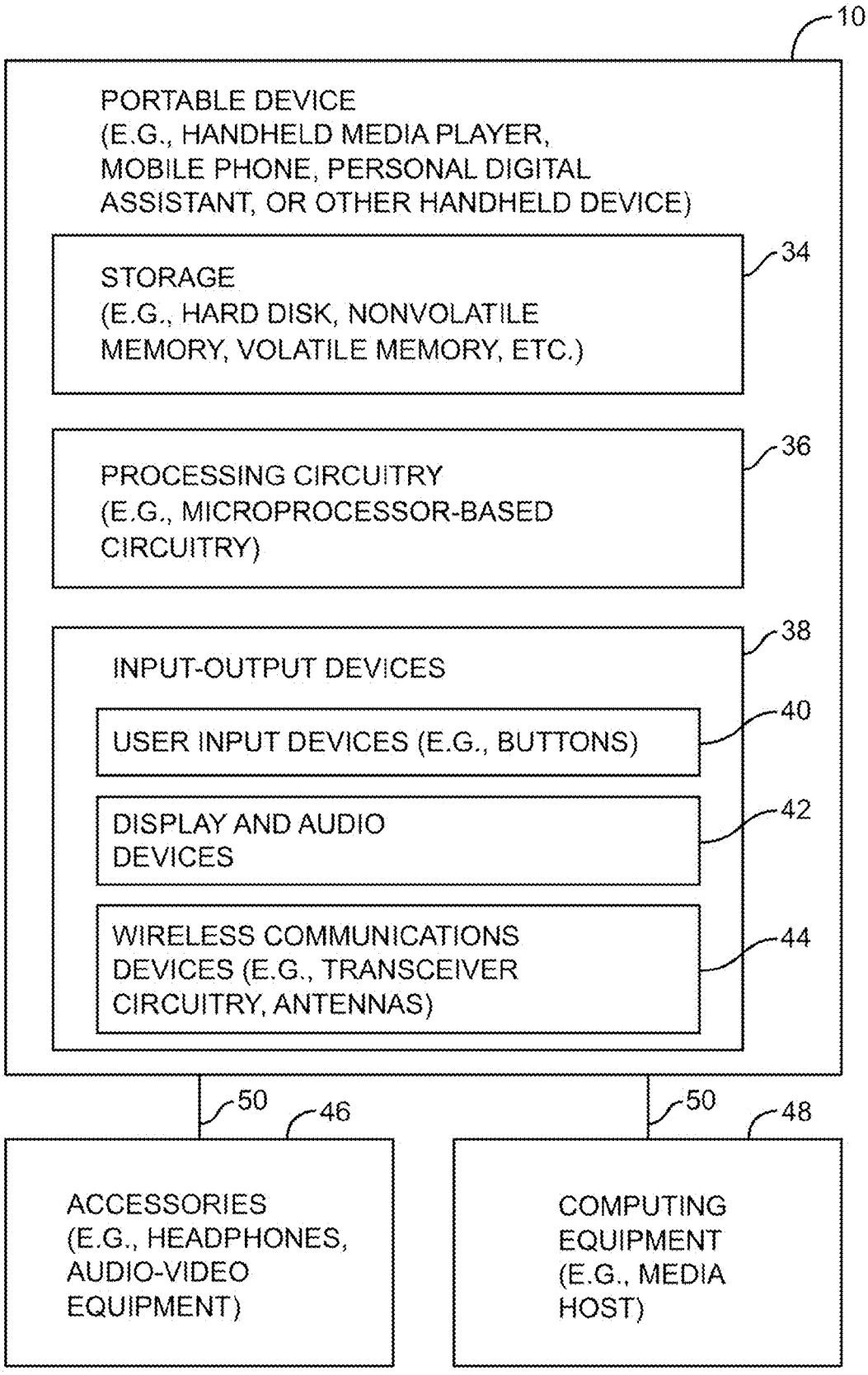
FIG. 2 is a schematic diagram of an illustrative handheld electronic device with an antenna in accordance with an embodiment of the present invention.

A schematic diagram of an embodiment of an illustrative handheld electronic device is shown in FIG. 2. Handheld device 10 may be a mobile telephone, a mobile telephone with media player capabilities, a handheld computer, a remote control, a game player, a global positioning system (GPS) device, a combination of such devices, or any other suitable portable electronic device.

As shown in FIG. 2, handheld device 10 may include storage 34. Storage 34 may include one or more different types of storage such as hard disk drive storage, nonvolatile memory (e.g., flash memory or other electrically-programmable-read-only memory), volatile memory (e.g., battery-based static or dynamic random-access-memory), etc.

Processing circuitry 36 may be used to control the operation of device 10. Processing circuitry 36 may be based on a processor such as a microprocessor and other suitable integrated circuits. With one suitable arrangement, processing circuitry 36 and storage 34 are used to run software on device 10, such as internet browsing applications, voice-over-internet-protocol (VOIP) telephone call applications, email applications, media playback applications, operating system functions, etc. Processing circuitry 36 and storage 34 may be used in implementing suitable communications protocols. Communications protocols that may be implemented using processing circuitry 36 and storage 34 include internet protocols, wireless local area network protocols (e.g., IEEE 802.11 protocols—sometimes referred to as WiFi®, protocols for other short-range wireless communications links such as the Bluetooth® protocol, etc.).

Input-output devices 38 may be used to allow data to be supplied to device 10 and to allow data to be provided from device 10 to external devices. Display screen 16 and user input interface 18 of FIG. 1 are examples of input-output devices 38.

Input-output devices 38 can include user input-output devices 40 such as buttons, touch screens, joysticks, click wheels, scrolling wheels, touch pads, key pads, keyboards, microphones, cameras, etc. A user can control the operation of device 10 by supplying commands through user input devices 40. Display and audio devices 42 may include liquid-crystal display (LCD) screens, light-emitting diodes (LEDs), and other components that present visual information and status data. Display and audio devices 42 may also include audio equipment such as speakers and other devices for creating sound. Display and audio devices 42 may contain audio-video interface equipment such as jacks and other connectors for external headphones and monitors.

Wireless communications devices 44 may include communications circuitry such as radio-frequency (RF) transceiver circuitry formed from one or more integrated circuits, power amplifier circuitry, passive RF components, two or more antennas, and other circuitry for handling RF wireless signals. Wireless signals can also be sent using light (e.g., using infrared communications).

Device 10 can communicate with external devices such as accessories 46 and computing equipment 48, as shown by paths 50. Paths 50 may include wired and wireless paths. Accessories 46 may include headphones (e.g., a wireless cellular headset or audio headphones) and audio-video equipment (e.g., wireless speakers, a game controller, or other equipment that receives and plays audio and video content).

Computing equipment 48 may be any suitable computer. With one suitable arrangement, computing equipment 48 is a computer that has an associated wireless access point (router) or an internal or external wireless card that establishes a wireless connection with device 10. The computer may be a server (e.g., an internet server), a local area network computer with or without internet access, a user's own personal computer, a peer device (e.g., another handheld electronic device 10), or any other suitable computing equipment.

The antennas and wireless communications devices of device 10 may support communications over any suitable wireless communications bands. For example, wireless communications devices 44 may be used to cover communications frequency bands such as the cellular telephone bands at 850 MHz, 900 MHz, 1800 MHz, and 1900 MHz, data service bands such as the 3G data communications band at 2170 MHz band (commonly referred to as UMTS or Universal Mobile Telecommunications System), the WiFi® (IEEE 802.11) bands at 2.4 GHz and 5.0 GHz, the Bluetooth® band at 2.4 GHz, and the global positioning system (GPS) band at 1550 MHz. These are merely illustrative communications bands over which devices 44 may operate. Additional local and remote communications bands are expected to be deployed in the future as new wireless services are made available. Wireless devices 44 may be configured to operate over any suitable band or bands to cover any existing or new services of interest. If desired, three or more antennas may be provided in wireless devices 44 to allow coverage of more bands, although the use of two antennas is primarily described herein as an example.

Figure 3A:
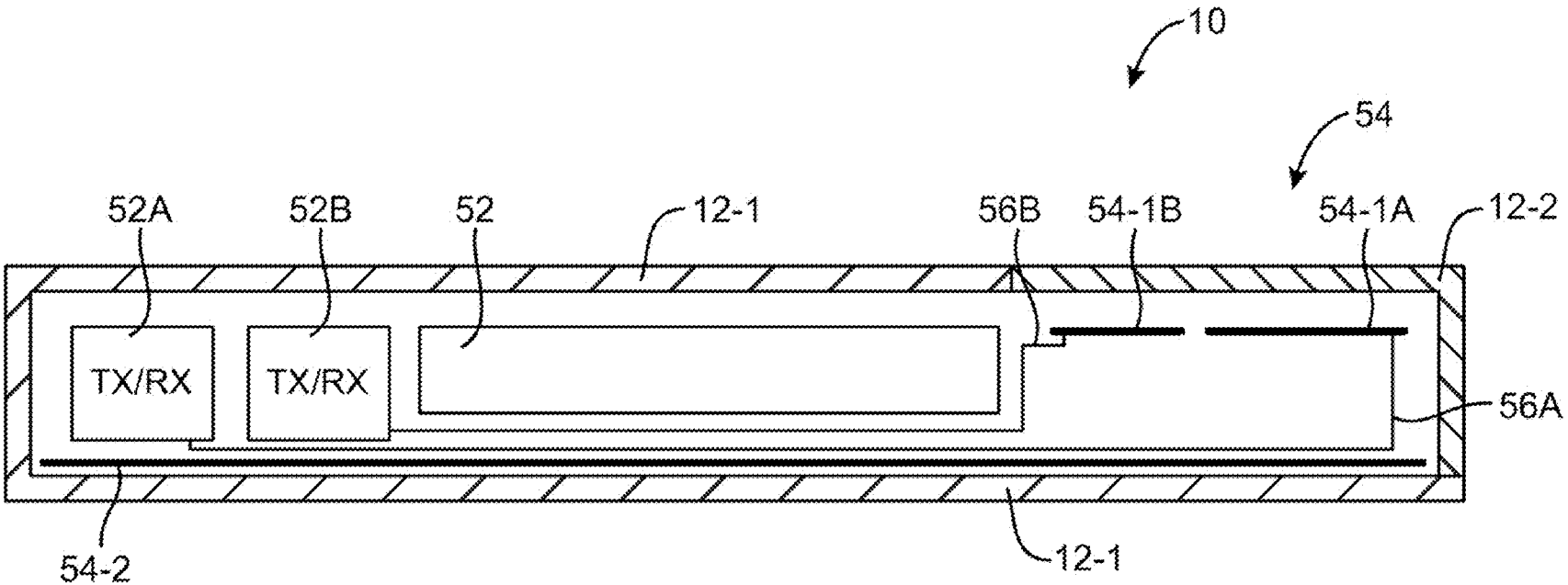
FIG. 3A is a cross-sectional side view of an illustrative handheld electronic device with an antenna in accordance with an embodiment of the present invention.

A cross-sectional view of an illustrative handheld electronic device is shown in FIG. 3A. In the example of FIG. 3A, device 10 has a housing that is formed of a conductive portion 12-1 and a plastic portion 12-2. Conductive portion 12-1 may be any suitable conductor. With one suitable arrangement, case portion 12-1 is formed from metals such as stamped 304 stainless steel. Stainless steel has a high conductivity and can be polished to a high-gloss finish so that it has an attractive appearance. If desired, other metals can be used for case portion 12-1 such as aluminum, magnesium, titanium, alloys of these metals and other metals, etc.

Housing portion 12-2 may be formed from a dielectric. An advantage of using dielectric for housing portion 12-2 is that this allows antenna resonating elements 54-1A and 54-1B of antennas 54 in device 10 to operate without interference from the metal sidewalls of housing 12. With one suitable arrangement, housing portion 12-2 is a plastic cap formed from a plastic based on acrylonitrile-butadiene-styrene copolymers (sometimes referred to as ABS plastic). These are merely illustrative housing materials for device 10. For example, the housing of device 10 may be formed substantially from plastic or other dielectrics, substantially from metal or other conductors, or from any other suitable materials or combinations of materials.

Components such as components 52 may be mounted on one or more circuit boards in device 10. Typical components include integrated circuits, LCD screens, and user input interface buttons. Device 10 also typically includes a battery, which may be mounted along the rear face of housing 12 (as an example). Transceiver circuits 52A and 52B may also be mounted to one or more circuit boards in device 10. If desired, there may be more transceivers. In a configuration for device 10 in which there are two antennas and two transceivers, each transceiver may be used to transmit radio-frequency signals through a respective antenna and may be used to receive radio-frequency signals through a respective antenna. For example, transceiver 52A may be used to transmit and receive cellular telephone radio-frequency signals and transceiver 52B may be used to transmit signals in a communications band such as the 3G data communications band at 2170 MHz band (commonly referred to as UMTS or Universal Mobile Telecommunications System), the WiFi® (IEEE 802.11) bands at 2.4 GHz and 5.0 GHz, the Bluetooth® band at 2.4 GHz, or the global positioning system (GPS) band at 1550 MHz.

The circuit board(s) in device 10 may be formed from any suitable materials. With one illustrative arrangement, device 10 is provided with a multilayer printed circuit board. At least one of the layers may have large uninterrupted planar regions of conductor that form a ground plane such as ground plane 54-2. In a typical scenario, ground plane 54-2 is a rectangle that conforms to the generally rectangular shape of housing 12 and device 10 and matches the rectangular lateral dimensions of housing 12. Ground plane 54-2 may, if desired, be electrically connected to conductive housing portion 12-1.

Suitable circuit board materials for the multilayer printed circuit board include paper impregnated with phonolic resin, resins reinforced with glass fibers such as fiberglass mat impregnated with epoxy resin (sometimes referred to as FR-4), plastics, polytetrafluoroethylene, polystyrene, polyimide, and ceramics. Circuit boards fabricated from materials such as FR-4 are commonly available, are not cost-prohibitive, and can be fabricated with multiple layers of metal (e.g., four layers). So-called flex circuits, which are formed using flexible circuit board materials such as polyimide, may also be used in device 10. For example, flex circuits may be used to form the antenna resonating elements for antennas 54.

As shown in the illustrative configuration of FIG. 3A, ground plane element 54-2 and antenna resonating element 54-1A may form a first antenna for device 10. Ground plane element 54-2 and antenna resonating element 54-1B may form a second antenna for device 10. If desired, other antennas can be provided for device 10 in addition to these two antennas. Such additional antennas may, if desired, be configured to provide additional gain for an overlapping frequency band of interest (i.e., a band at which one of these antennas 54 is operating) or may be used to provide coverage in a different frequency band of interest (i.e., a band outside of the range of antennas 54).

Any suitable conductive materials may be used to form ground plane element 54-2 and resonating elements 54-1A and 54-1B in the antennas. Examples of suitable conductive materials for the antennas include metals, such as copper, brass, silver, and gold. Conductors other than metals may also be used, if desired. The conductive elements in antennas 54 are typically thin (e.g., about 0.2 mm).

Transceiver circuits 52A and 52B (i.e., transceiver circuitry 44 of FIG. 2) may be provided in the form of one or more integrated circuits and associated discrete components (e.g., filtering components). These transceiver circuits may include one or more transmitter integrated circuits, one or more receiver integrated circuits, switching circuitry, amplifiers, etc. Transceiver circuits 52A and 52B may operate simultaneously (e.g., one can transmit while the other receives, both can transmit at the same time, or both can receive simultaneously).

Each transceiver may have an associated coaxial cable or other transmission line over which transmitted and received radio frequency signals are conveyed. As shown in the example of FIG. 3A, transmission line 56A (e.g., a coaxial cable) may be used to interconnect transceiver 52A and antenna resonating element 54-1A and transmission line 56B (e.g., a coaxial cable) may be used to interconnect transceiver 52B and antenna resonating element 54-1B. With this type of configuration, transceiver 52B may handle WiFi transmissions over an antenna formed from resonating element 54-1B and ground plane 54-2, while transceiver 52A may handle cellular telephone transmission over an antenna formed from resonating element 54-1A and ground plane 54-2.

Figure 3B:
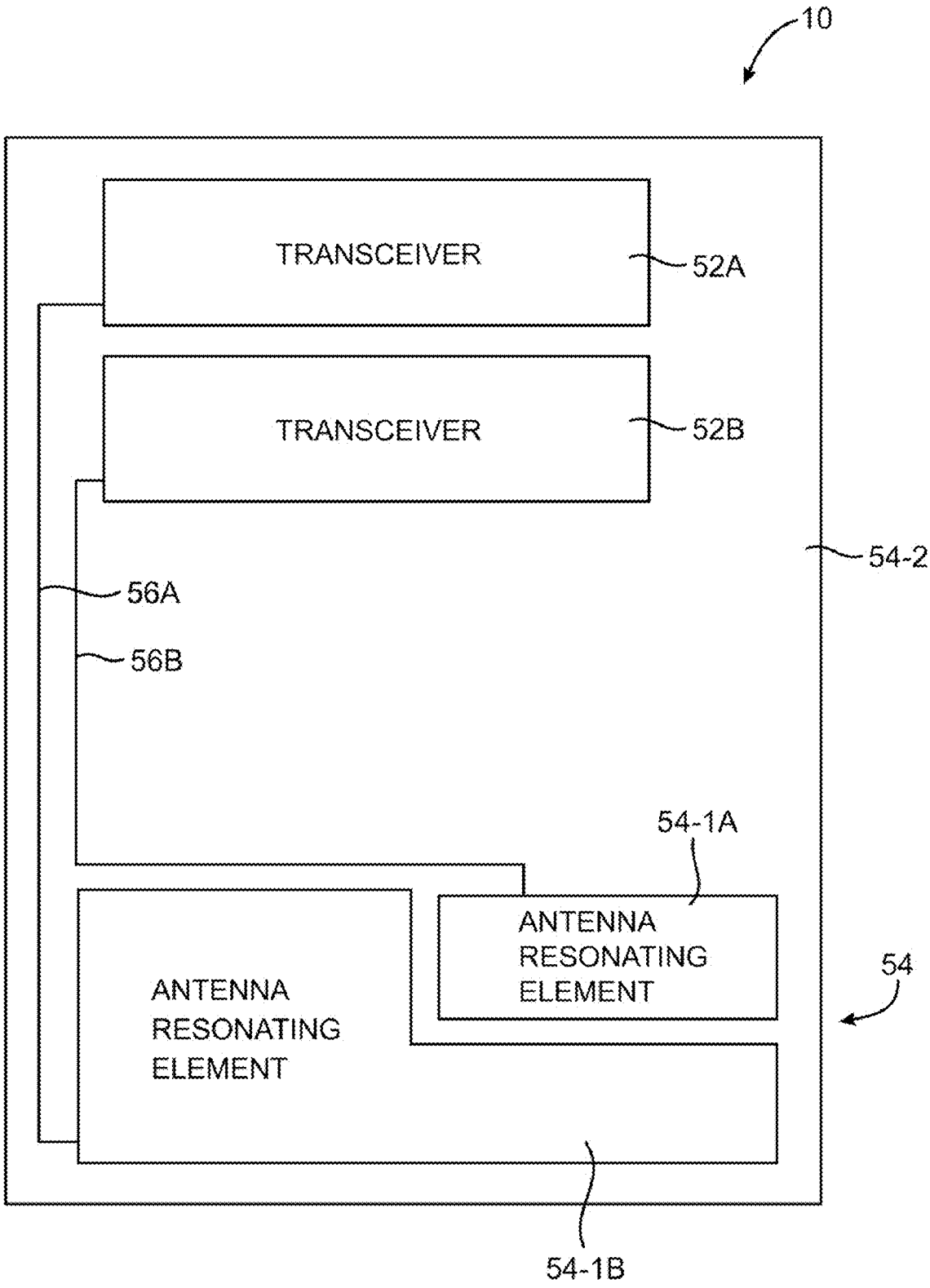
FIG. 3B is a partly schematic top view of an illustrative handheld electronic device containing two radio-frequency transceivers that are coupled to two associated antenna resonating elements by respective transmission lines in accordance with an embodiment of the present invention.

A top view of an illustrative device 10 in accordance with an embodiment of the present invention is shown in FIG. 3B. As shown in FIG. 3B, transceiver circuitry such as transceiver 52A and transceiver 52B may be interconnected with antenna resonating elements 54-1A and 54-1B over respective transmission lines 56A and 56B. Ground plane 54-2 may have a substantially rectangular shape (i.e., the lateral dimensions of ground plane 54-2 may match those of device 10). Ground plane 54-2 may be formed from one or more printed circuit board conductors, conductive housing portions (e.g., housing portion 12-1 of FIG. 3A), or any other suitable conductive structure.

Antenna resonating elements 54-1A and 54-1B and ground plane 54-2 may be formed in any suitable shapes. With one illustrative arrangement, one of antennas 54 (i.e., the antenna formed from resonating element 54-1A) is based at least partly on a planar inverted-F antenna (PIFA) structure and the other antenna (i.e., the antenna formed from resonating element 54-1B) is based on a planar strip configuration.

Although this embodiment may be described herein as an example, any other suitable shapes may be used for resonating element 54-1A and 54-1B if desired.

Figure 4:
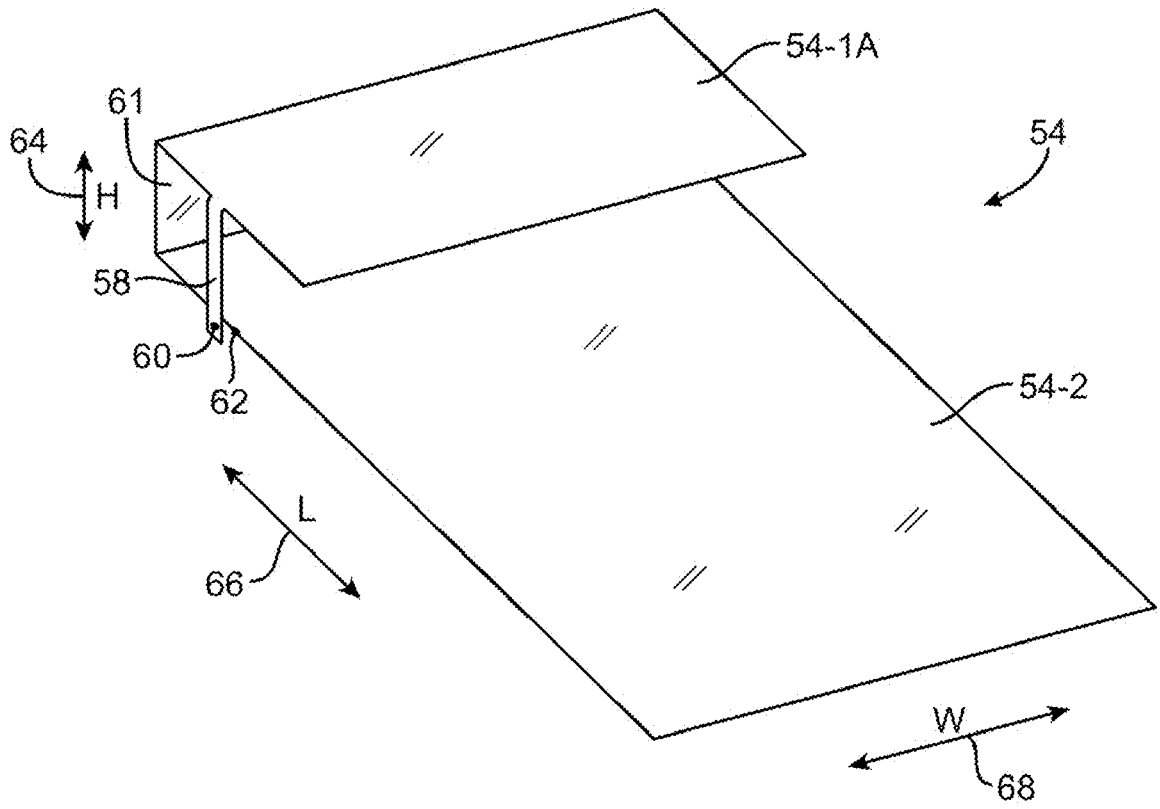
FIG. 4 is a perspective view of an illustrative planar inverted-F antenna (PIFA) in accordance with an embodiment of the present invention.

An illustrative PIFA structure that may be used in device 10 is shown in FIG. 4. As shown in FIG. 4, PIFA structure 54 may have a ground plane portion 54-2 and a planar resonating element portion 54-1. Antennas are fed using positive signals and ground signals. The portion of an antenna to which the positive signal is provided is sometimes referred to as the antenna's positive terminal or feed terminal. This terminal is also sometimes referred to as the signal terminal or the center-conductor terminal of the antenna. The portion of an antenna to which the ground signal is provided may be referred to as the antenna's ground, the antenna's ground terminal, the antenna's ground plane, etc. In antenna 54 of FIG. 4, feed conductor 58 is used to route positive antenna signals from signal terminal 60 into antenna resonating element 54-1. Ground terminal 62 is shorted to ground plane 54-2, which forms the antenna's ground.

The dimensions of the ground plane in a PIFA antenna such as antenna 54 of FIG. 4 are generally sized to conform to the maximum size allowed by housing 12 of device 10. Antenna ground plane 54-2 may be rectangular in shape having width W in lateral dimension 68 and length L in lateral dimension 66. The length of antenna 54 in dimension 66 affects its frequency of operation. Dimensions 68 and 66 are sometimes referred to as horizontal dimensions. Resonating element 54-1 is typically spaced several millimeters from ground plane 54-2 along vertical dimension 64. The size of antenna 54 in dimension 64 is sometimes referred to as height H of antenna 54.

Figure 5:
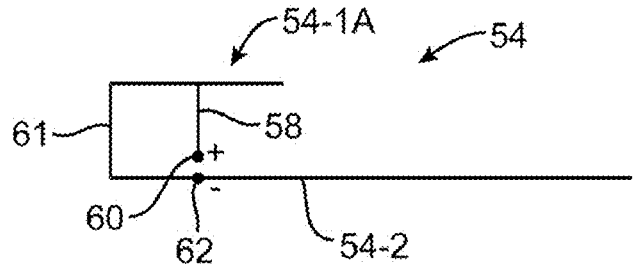
FIG. 5 is a cross-sectional side view of an illustrative planar inverted-F antenna of the type shown in FIG. 4 in accordance with an embodiment of the present invention.

A cross-sectional view of PIFA antenna 54 of FIG. 4 is shown in FIG. 5. As shown in FIG. 5, radio-frequency signals may be fed to antenna 54 (when transmitting) and may be received from antenna 54 (when receiving) using signal terminal 60 and ground terminal 62. In a typical arrangement, a coaxial conductor or other transmission line has its center conductor electrically connected to point 60 and its ground conductor electrically connected to point 62.

Figure 6:
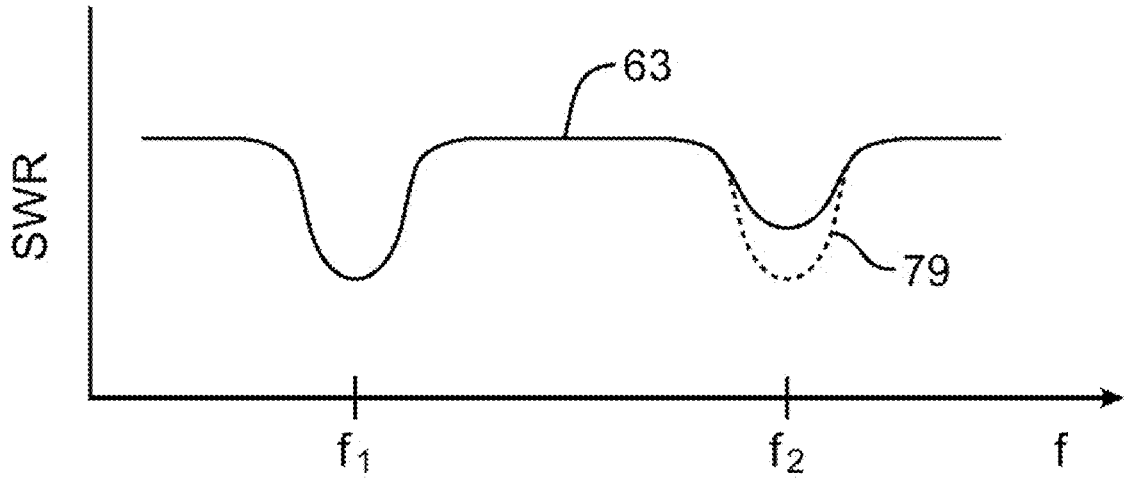
FIG. 6 is an illustrative antenna performance graph for an antenna of the type shown in FIGS. 4 and 5 in which standing-wave-ratio (SWR) values are plotted as a function of operating frequency.

A graph of the expected performance of an antenna of the type represented by illustrative antenna 54 of FIGS. 4 and 5 is shown in FIG. 6. Expected standing wave ratio (SWR) values are plotted as a function of frequency. The performance of antenna 54 of FIGS. 4 and 5 is given by solid line 63. As shown, there is a reduced SWR value at frequency $f_1$, indicating that the antenna performs well in the frequency band centered at frequency $f_1$. PIFA antenna 54 also operates at harmonic frequencies such as frequency $f_2$. Frequency $f_2$ represents the second harmonic of PIFA antenna 54 (i.e., $f_2=2f_1$). The dimensions of antenna 54 may be selected so that frequencies $f_1$ and $f_2$ are aligned with communication bands of interest. The frequency $f_1$ (and harmonic frequency $2f_1$) are related to the length L of antenna 54 in dimension 66 (L is approximately equal to one quarter of a wavelength at frequency $f_1$).

The height H of antenna 54 of FIGS. 4 and 5 in dimension 64 is limited by the amount of near-field coupling between resonating element 54-1A and ground plane 54-2. For a specified antenna bandwidth and gain, it is not possible to reduced the height H without adversely affecting performance. All other variables being equal, reducing height H will cause the bandwidth and gain of antenna 54 to be reduced.

Figure 7:
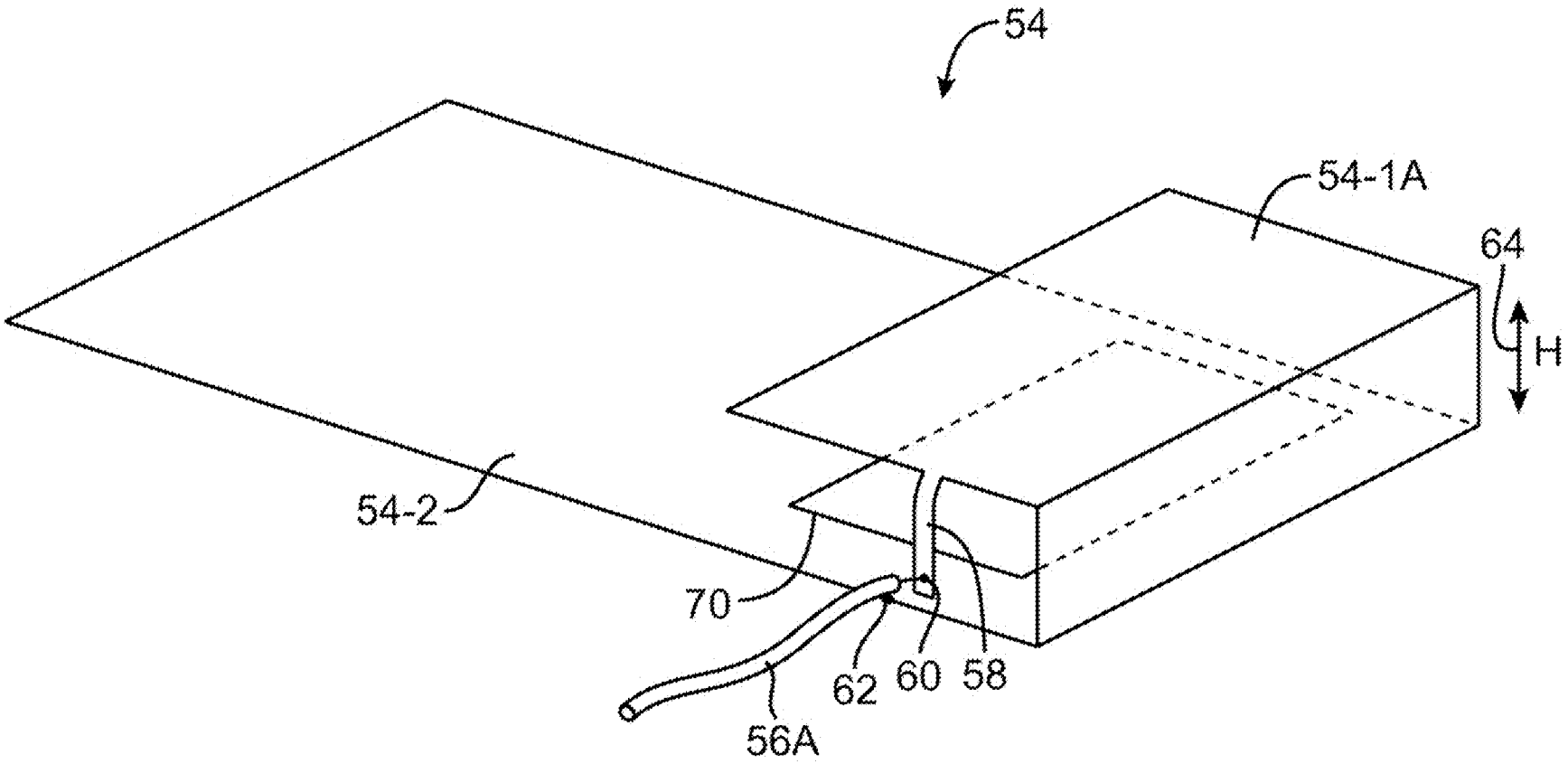
FIG. 7 is a perspective view of an illustrative planar inverted-F antenna in which a portion of the antenna's ground plane underneath the antenna's resonating element has been removed to form a slot in accordance with an embodiment of the present invention.

As shown in FIG. 7, the minimum vertical dimension of the PIFA antenna can be reduced while still satisfying minimum bandwidth and gain constraints by introducing a dielectric region 70 in the area under antenna resonating element 54-1A. The dielectric region 70 may be filled with air, plastic, or any other suitable dielectric and represents a cut-away or removed portion of ground plane 54-2. Removed or empty region 70 may be formed from one or more holes in ground plane 54-2. These holes may be square, circular, oval, polygonal, etc. and may extend though adjacent conductive structures in the vicinity of ground plane 54-2. With one suitable arrangement, which is shown in FIG. 7, the removed region 70 is rectangular and forms a slot. The slot may be any suitable size. For example, the slot may be slightly smaller than the outermost rectangular outline of resonating elements 54-1A and 54-2 as viewed from the top view orientation of FIG. 3B. Typical resonating element lateral dimensions are on the order of 0.5 cm to 10 cm.

The presence of slot 70 reduces near-field electromagnetic coupling between resonating element 54-1A and ground plane 54-2 and allows height H in vertical dimension 64 to be made smaller than would otherwise be possible while satisfying a given set of bandwidth and gain constraints. For example, height H may be in the range of 1-5 mm, may be in the range of 2-5 mm, may be in the range of 2-4 mm, may be in the range of 1-3 mm, may be in the range of 1-4 mm, may be in the range of 1-10 mm, may be lower than 10 mm, may be lower than 4 mm, may be lower than 3 mm, may be lower than 2 mm, or may be in any other suitable range of vertical displacements above ground plane element 54-2.

If desired, the portion of ground plane 54-2 that contains slot 70 may be used to form a slot antenna. The slot antenna structure may be used at the same time as the PIFA structure to form a hybrid antenna 54. By operating antenna 54 so that it exhibits both PIFA operating characteristics and slot antenna operating characteristics, antenna performance can be improved.

Figure 8:
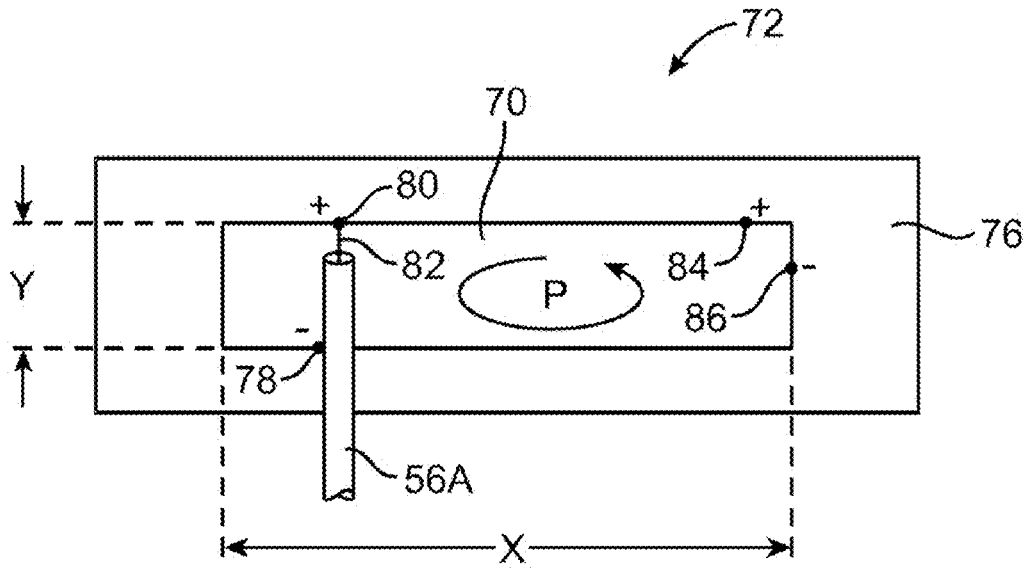
FIG. 8 is a top view of an illustrative slot antenna in accordance with an embodiment of the present invention.

A top view of an illustrative slot antenna is shown in FIG. 8. Antenna 72 of FIG. 8 is typically thin in the dimension into the page (i.e., antenna 72 is planar with its plane lying in the page). Slot 70 may be formed in the center of antenna 72. A coaxial cable such as cable 56A or other transmission line path may be used to feed antenna 72. In the example of FIG. 8, antenna 72 is fed so that center conductor 82 of coaxial cable 56A is connected to signal terminal 80 (i.e., the positive or feed terminal of antenna 72) and the outer braid of coaxial cable 56A, which forms the ground conductor for cable 56A, is connected to ground terminal 78.

Figure 9:
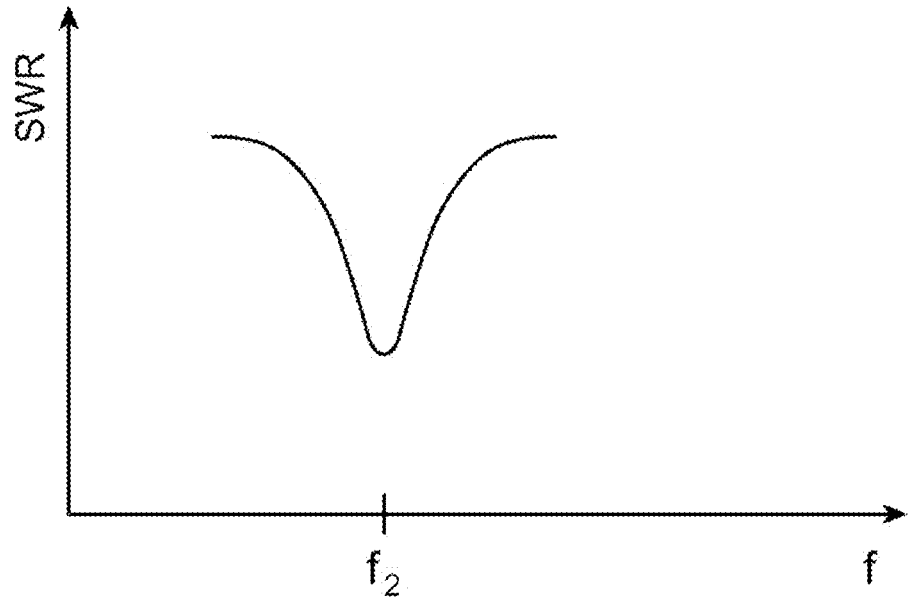
FIG. 9 is an illustrative antenna performance graph for an antenna of the type shown in FIG. 8 in which standing-wave-ratio (SWR) values are plotted as a function of operating frequency.

When antenna 72 is fed using the arrangement of FIG. 8, the antenna's performance is given by the graph of FIG. 9. As shown in FIG. 9, antenna 72 operates in a frequency band that is centered about center frequency $f_2$. The center frequency $f_2$ is determined by the dimensions of slot 70. Slot 70 has an inner perimeter P that is equal to two times dimension X plus two times dimension Y (i.e., P=2X+2Y). At center frequency $f_2$, perimeter P is equal to one wavelength.

Because the center frequency $f_2$ can be tuned by proper selection of perimeter P, the slot antenna of FIG. 8 can be configured so that frequency $f_2$ of the graph in FIG. 9 coincides with frequency $f_2$ of the graph in FIG. 6. In an antenna design in which slot 70 is combined with a PIFA structure, the presence of slot 70 increases the gain of the antenna at frequency $f_2$. In the vicinity of frequency $f_2$, the increase in performance from using slot 70 results in the antenna performance plot given by dotted line 79 in FIG. 6.

The position of terminals 80 and 78 may be selected for impedance matching. If desired, terminals such as terminals 84 and 86, which extend around one of the corners of slot 70 may be used to feed antenna 72. In this situation, the distance between terminals 84 and 86 may be chosen to properly adjust the impedance of antenna 72. In the illustrative arrangement of FIG. 8, terminals 84 and 86 are shown as being respectively configured as a slot antenna ground terminal and a slot antenna signal terminal, as an example. If desired, terminal 84 could be used as a ground terminal and terminal 86 could be used as a signal terminal. Slot 70 is typically air-filled, but may, in general, by filled with any suitable dielectric.

By using slot 70 in combination with a PIFA-type resonating element such as resonating element 54-1, a hybrid PIFA/slot antenna is formed. Handheld electronic device 10 may, if desired, have a PIFA/slot hybrid antenna of this type (e.g., for cellular telephone communications) and a strip antenna (e.g., for WiFi/Bluetooth communications).

Figure 10:
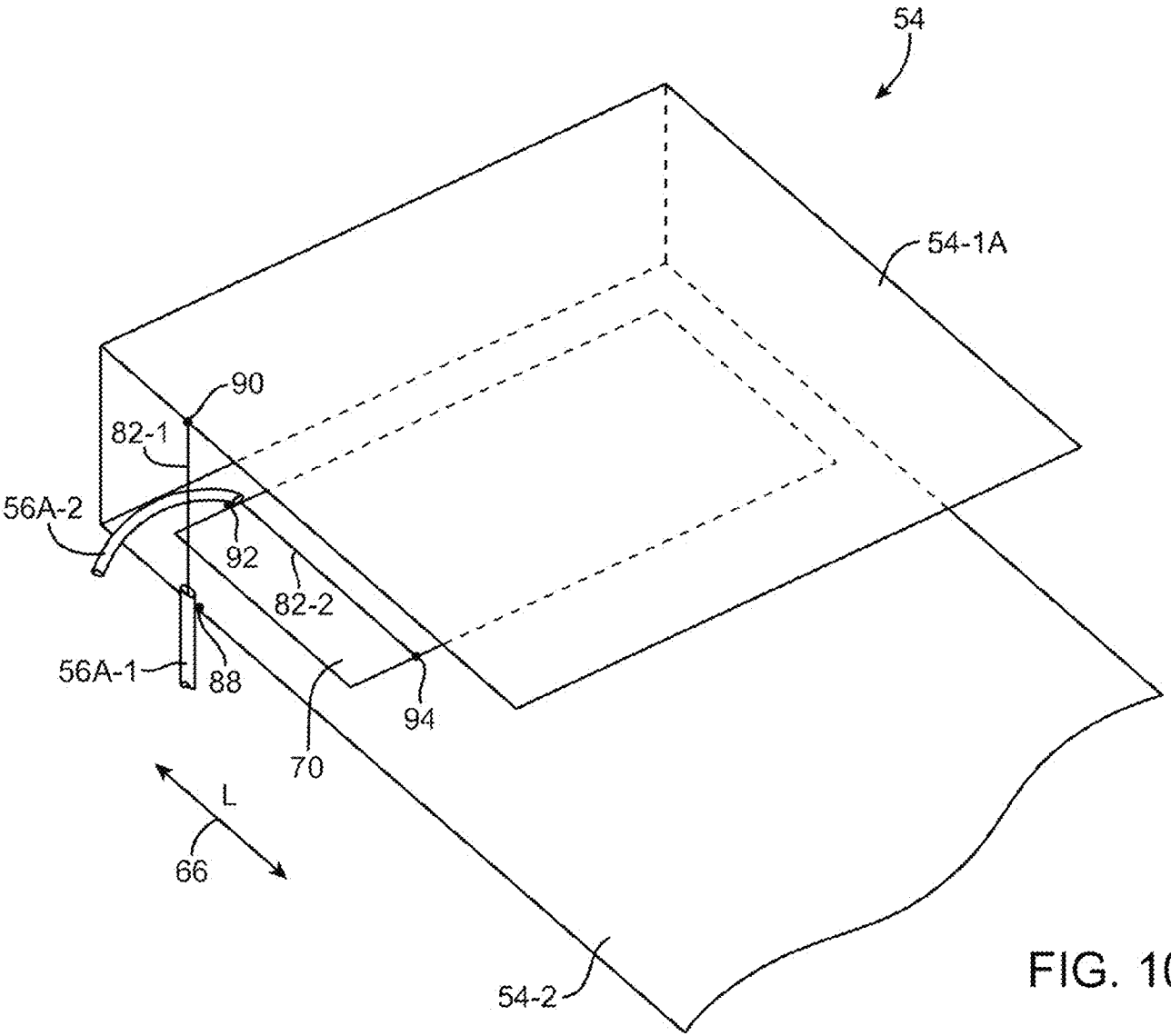
FIG. 10 is a perspective view of an illustrative hybrid PIFA/slot antenna formed by combining a planar inverted-F antenna with a slot antenna in which the antenna is being fed by two coaxial cable feeds in accordance with an embodiment of the present invention.

An illustrative configuration in which the hybrid PIFA/slot antenna formed by resonating element 54-1A, slot 70, and ground plane 54-2 is fed using two coaxial cables (or other transmission lines) is shown in FIG. 10. When the antenna is fed as shown in FIG. 10, both the PIFA and slot antenna portions of the antenna are active. As a result, antenna 54 of FIG. 10 operates in a hybrid PIFA/slot mode. Coaxial cables 56A-1 and 56A-2 have inner conductors 82-1 and 82-2, respectively. Coaxial cables 56A-1 and 56A-2 also each have a conductive outer braid ground conductor. The outer braid conductor of coaxial cable 56A-1 is electrically shorted to ground plane 54-2 at ground terminal 88. The ground portion of cable 56A-2 is shorted to ground plane 54-2 at ground terminal 92. The signal connections from coaxial cables 56A-1 and 56A-2 are made at signal terminals 90 and 94, respectively.

With the arrangement of FIG. 10, two separate sets of antenna terminals are used. Coaxial cable 56A-1 feeds the PIFA portion of the hybrid PIFA/slot antenna using ground terminal 88 and signal terminal 90 and coaxial cable 56A-2 feeds the slot antenna portion of the hybrid PIFA/slot antenna using ground terminal 92 and signal terminal 94. Each set of antenna terminals therefore operates as a separate feed for the hybrid PIFA/slot antenna. Signal terminal 90 and ground terminal 88 serve as antenna terminals for the PIFA portion of the antenna, whereas signal terminal 94 and ground terminal 92 serve as antenna feed points for the slot portion of antenna 54. These two separate antenna feeds allow the antenna to function simultaneously using both its PIFA and its slot characteristics. If desired, the orientation of the feeds can be changed. For example, coaxial cable 56A-2 may be connected to slot 70 using point 94 as a ground terminal and point 92 as a signal terminal or using ground and signal terminals located at other points along the periphery of slot 70.

When multiple transmission lines such as transmission lines 56A-1 and 56-2 are used for the hybrid PIFA/slot antenna, each transmission line may be associated with a respective transceiver circuit (e.g., two corresponding transceiver circuits such as transceiver circuit 52A of FIGS. 3A and 3B).

In operation in handheld device 10, a hybrid PIFA/slot antenna formed from resonating element 54-1A of FIG. 3B and a corresponding slot that is located beneath element 54-1A in ground plane 54-2 can be used to cover the GSM cellular telephone bands at 850 and 900 MHz and at 1800 and 1900 MHz (or other suitable frequency bands), whereas a strip antenna (or other suitable antenna structure) can be used to cover an additional band centered at frequency $f_n$ (or another suitable frequency band or bands). By adjusting the size of the strip antenna or other antenna structure formed from resonating element 54-1B, the frequency $f_n$ may be controlled so that it coincides with any suitable frequency band of interest (e.g., 2.4 GHz for Bluetooth/WiFi, 2170 MHz for UMTS, or 1550 MHz for GPS).

Figure 11:
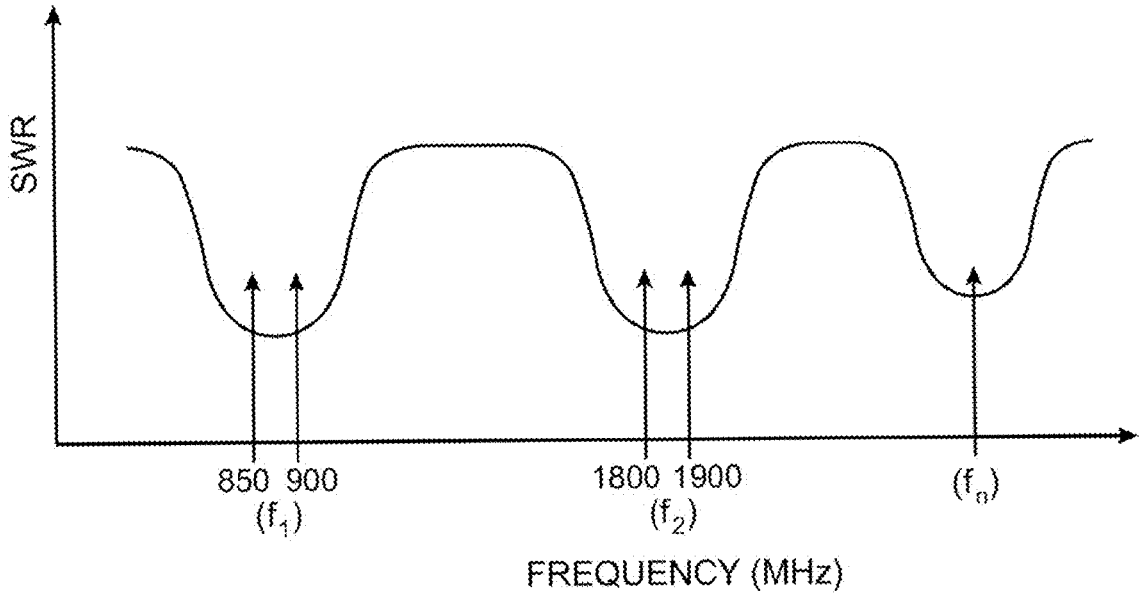
FIG. 11 is an illustrative wireless coverage graph in which antenna standing-wave-ratio (SWR) values are plotted as a function of operating frequency for a handheld device that contains a hybrid PIFA/slot antenna and a strip antenna in accordance with an embodiment of the present invention.

A graph showing the wireless performance of device 10 when using two antennas (e.g., a hybrid PIFA/slot antenna formed from resonating element 54-1A and a corresponding slot and an antenna formed from resonating element 54-2) is shown in FIG. 11. In the example of FIG. 11, the PIFA operating characteristics of the hybrid PIFA/slot antenna are used to cover the 850/900 MHz and the 1800/1900 MHz GSM cellular telephone bands, the slot antenna operating characteristics of the hybrid PIFA/slot antenna are used to provide additional gain and bandwidth in the 1800/1900 MHz range, and the antenna formed from resonating element 54-1B is used to cover the frequency band centered at $f_n$ (e.g., 2.4 GHz for Bluetooth/WiFi, 2170 MHz for UMTS, or 1550 MHz for GPS). This arrangement provides coverage for four cellular telephone bands and a data band.

Figure 12:
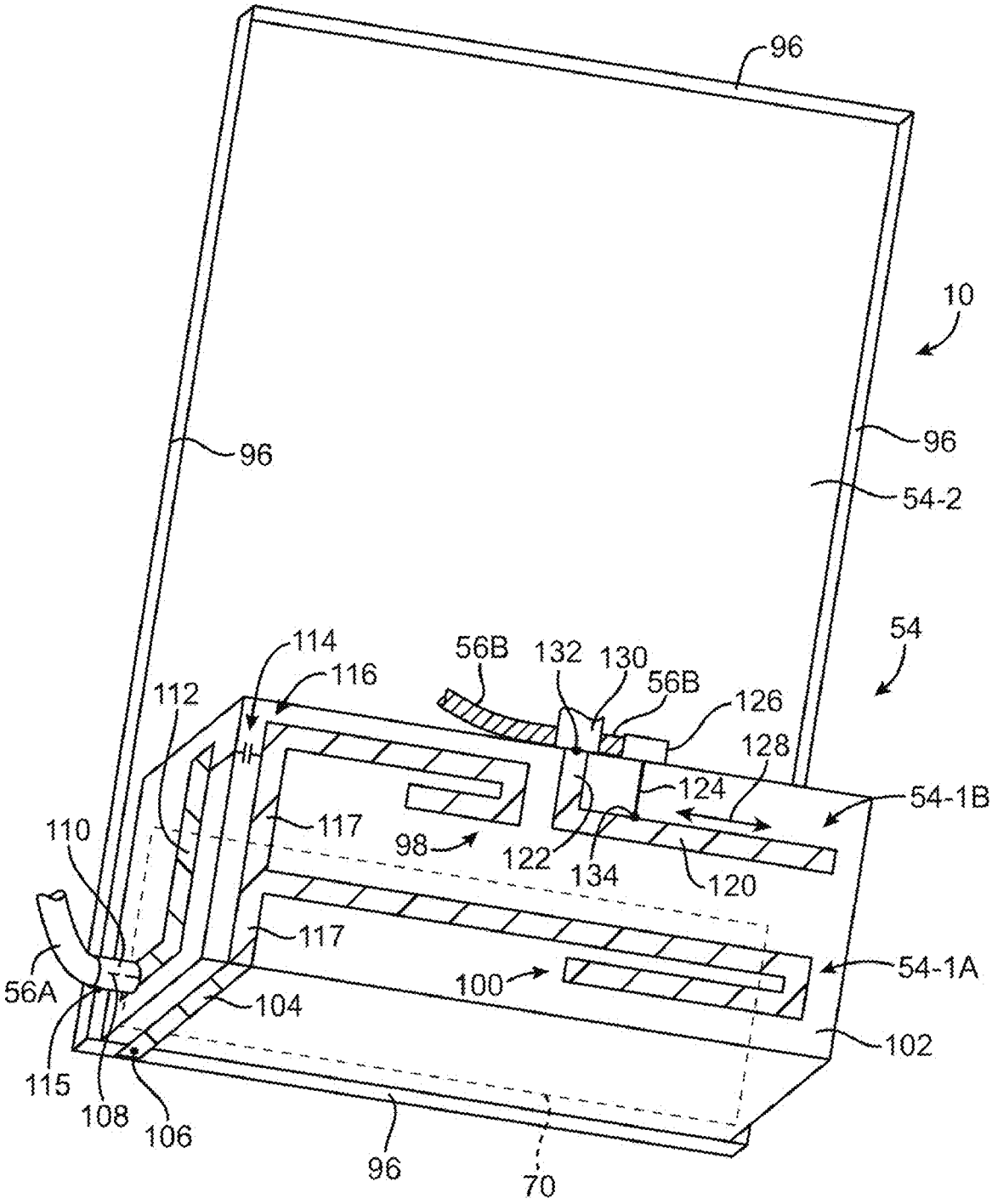
FIG. 12 is a perspective view of an illustrative handheld electronic device antenna arrangement in which a first of two handheld electronic device antennas has an associated isolation element that serves to reduce interference with from a second of the two handheld electronic device antennas in accordance with an embodiment of the present invention.

If desired, the hybrid PIFA/slot antenna formed from resonating element 54-1A and slot 70 may be fed using a single coaxial cable or other such transmission line. An illustrative configuration in which a single transmission line is used to simultaneously feed both the PIFA portion and the slot portion of the hybrid PIFA/slot antenna and in which a strip antenna formed from resonating element 54-1B is used to provide additional frequency coverage for device 10 is shown in FIG. 12. Ground plane 54-2 may be formed from metal (as an example). Edges 96 of ground plane 54-2 may be formed by bending the metal of ground plane 54-2 upward. When inserted into housing 12 (FIG. 3A), edges 96 may rest within the sidewalls of metal housing portion 12-1. If desired, ground plane 54-2 may be formed using one or more metal layers in a printed circuit board, metal foil, portions of housing 12, or other suitable conductive structures.

In the embodiment of FIG. 12, resonating element 54-1B has an L-shaped conductive strip formed from conductive branch 122 and conductive branch 120. Branches 120 and 122 may be formed from metal that is supported by dielectric support structure 102. With one suitable arrangement, the resonating element structures of FIG. 12 are formed as part of a patterned flex circuit that is attached to support structure 102 (e.g., by adhesive).

Coaxial cable 56B or other suitable transmission line has a ground conductor connected to ground terminal 132 and a signal conductor connected to signal terminal 124. Any suitable mechanism may be used for attaching the transmission line to the antenna. In the example of FIG. 12, the outer braid ground conductor of coaxial cable 56B is connected to ground terminal 132 using metal tab 130. Metal tab 130 may be shorted to housing portion 12-1 (e.g., using conductive adhesive). Transmission line connection structure 126 may be, for example, a mini UFL coaxial connector. The ground of connector 126 may be shorted to terminal 132 and the center conductor of connector 126 may be shorted to conductive path 124.

When feeding antenna 54-1B, terminal 132 may be considered to form the antenna's ground terminal and the center conductor of connector 126 and/or conductive path 124 may be considered to form the antenna's signal terminal. The location along dimension 128 at which conductive path 124 meets conductive strip 120 can be adjusted for impedance matching.

Planar antenna resonating element 54-1A of the hybrid PIFA/slot antenna of FIG. 12 may have an F-shaped structure with shorter arm 98 and longer arm 100. The lengths of arms 98 and 100 and the dimensions of other structures such as slot 70 and ground plane 54-2 may be adjusted to tune the frequency coverage and antenna isolation properties of device 10. For example, length L of ground plane 54-2 may be configured so that the PIFA portion of the hybrid PIFA/slot antenna formed with resonating element 54-1A resonates at the 850/900 MHz GSM bands, thereby providing coverage at frequency $f_1$ of FIG. 11. The length of arm 100 may be selected to resonate at the 1800/1900 MHz bands, thereby helping the PIFA/slot antenna to provide coverage at frequency $f_2$ of FIG. 11. The perimeter of slot 70 may be configured to resonate at the 1800/1900 MHz bands, thereby reinforcing the resonance of arm 100 and further helping the PIFA/slot antenna to provide coverage at frequency $f_2$ of FIG. 11 (i.e., by improving performance from the solid line 63 to the dotted line 79 in the vicinity of frequency $f_2$, as shown in FIG. 6).

Arm 98 can serve as an isolation element that reduces interference between the hybrid PIFA/slot antenna formed from resonating element 54-1A and the L-shaped strip antenna formed from resonating element 54-1B. The dimensions of arm 98 can be configured to introduce an isolation maximum at a desired frequency, which is not present without the arm. It is believed that configuring the dimensions of arm 98 allows manipulation of the currents induced on the ground plane 54-2 from resonating element 54-1A. This manipulation can minimize induced currents around the signal and ground areas of resonating element 54-1B. Minimizing these currents in turn reduces the signal coupling between the two antenna feeds. With this arrangement, arm 98 can be configured to resonate at a frequency that minimizes currents induced by arm 100 at the feed of the antenna formed from resonating element 54-1B (i.e., in the vicinity of paths 122 and 124).

Additionally, arm 98 can act as a radiating arm for element 54-1A. Its resonance can add to the bandwidth of element 54-1A and can improve in-band efficiency, even though its resonance may be different than that defined by slot 70 and arm 100. Typically an increase in bandwidth of radiating element 51-1A that reduces its frequency separation from element 51-1B would be detrimental to isolation. However, extra isolation afforded by arm 98 removes this negative effect and, moreover, provides significant improvement with respect to the isolation between elements 54-1A and 54-1B without arm 98.

Figure 13:
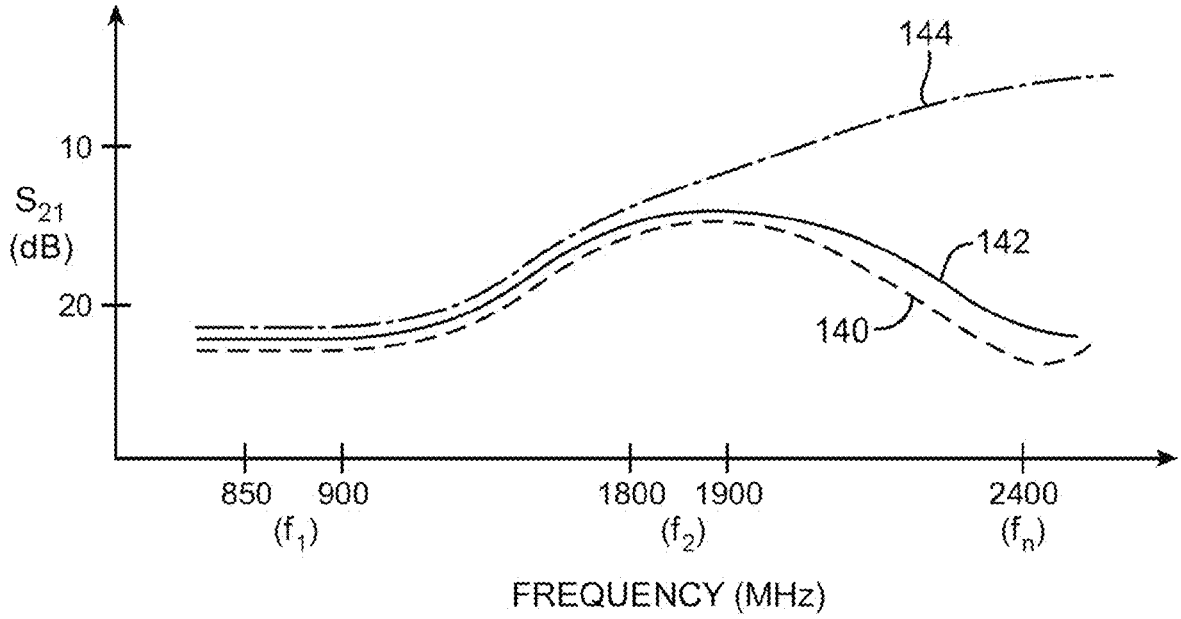
FIG. 13 is a graph in which antenna isolation performance is plotted as a function of operating frequency for an unisolated antenna arrangement and an antenna arrangement with an isolation element in accordance with an embodiment of the present invention.

The impact that use of an isolating element such as arm 98 has on antenna isolation performance in device 10 is shown in the graph of FIG. 13. The amount of signal appearing on one antenna as a result of signals on the other antenna (the $S_{21}$ value for the antennas) is plotted as a function of frequency. The amount of isolation that is required for device 10 depends on the type of circuitry used in the transceivers, the types of data rates that are desired, the amount of external interference that is anticipated, the frequency band of operation, the types of applications being run on device 10, etc. In general, isolation levels of 7 dB or less are considered poor and isolation levels of 20-25 dB are considered good. An illustrative desired minimum isolation level for a handheld electronic device is depicted by solid line 142. As this example illustrates, there may be a frequency dependence to the amount of antenna interference that a given design may tolerate. Isolation requirements may (as an example) be less for operation in the vicinity of frequency $f_2$ than when operating at frequencies $f_1$ and $f_n$.

In the example of FIG. 13, the strip antenna has been configured for operation at 2.4 GHz (e.g., for WiFi/Bluetooth). Dashed-and-dotted line 144 represents the isolation performance of the antennas when no isolation element such as arm 98 is used. As shown by line 144, isolation performance for this type of antenna arrangement is poor, because isolation at 2.4 GHz is less than 7 dB. In contrast, dashed line 140 depicts the isolation performance of antennas of the type shown in FIG. 12 in which an isolation element such as arm 98 is used. When arm 98 is used, isolation performance is improved. As shown by the position of line 140, the isolation performance of the illustrative antennas of FIG. 12 meets or exceeds the minimum requirements set by line 142.

As shown in FIG. 12, arms 98 and 100 of resonating element 54-1A and resonating element 54-1B may be mounted on support structure 102. Support structure 102 may be formed from plastic (e.g., ABS plastic) or other suitable dielectric. The surfaces of structure 102 may be flat or curved. The resonating elements 54-1A and 54-1B may be formed directly on support structure 102 or may be formed on a separate structure such as a flex circuit substrate that is attached to support structure 102 (as examples).

Resonating elements 54-1A and 54-1B may be formed by any suitable antenna fabrication technique such as metal stamping, cutting, etching, or milling of conductive tape or other flexible structures, etching metal that has been sputter-deposited on plastic or other suitable substrates, printing from a conducive slurry (e.g., by screen printing techniques), patterning metal such as copper that makes up part of a flex circuit substrate that is attached to support 102 by adhesive, screws, or other suitable fastening mechanisms, etc.

A conductive path such as conductive strip 104 may be used to electrically connect the resonating element 54-1A to ground plane 54-2 at terminal 106. A screw or other fastener at terminal 106 may be used to electrically and mechanically connect strip 104 (and therefore resonating element 54-1A) to edge 96 of ground plane 54-2. Conductive structures such as strip 104 and other such structures in the antennas may also be electrically connected to each other using conductive adhesive.

A coaxial cable such as cable 56A or other transmission line may be connected to the hybrid PIFA/slot antenna to transmit and receive radio-frequency signals. The coaxial cable or other transmission line may be connected to the structures of the hybrid PIFA/slot antenna using any suitable electrical and mechanical attachment mechanism. As shown in the illustrative arrangement of FIG. 12, mini UFL coaxial connector 110 may be used to connect coaxial cable 56A or other transmission lines to antenna conductor 112. A center conductor of the coaxial cable or other transmission line is connected to center connector 108 of connector 110. An outer braid ground conductor of the coaxial cable is electrically connected to ground plane 54-2 via connector 110 at point 115 (and, if desired, may be shorted to ground plane 54-2 at other attachment points upstream of connector 110).

Conductor 108 may be electrically connected to antenna conductor 112. Conductor 112 may be formed from a conductive element such as a strip of metal formed on a sidewall surface of support structure 102. Conductor 112 may be directly electrically connected to resonating element 54-1A (e.g., at portion 116) or may be electrically connected to resonating element 54-1A through tuning capacitor 114 or other suitable electrical components. The size of tuning capacitor 114 can be selected to tune antenna 54 and ensure that antenna 54 covers the frequency bands of interest for device 10.

Slot 70 may lie beneath resonating element 54-1A of FIG. 12. The signal from center conductor 108 may be routed to point 106 on ground plane 54-2 in the vicinity of slot 70 using a conductive path formed from antenna conductor 112, optional capacitor 114 or other such tuning components, antenna conductor 117, and antenna conductor 104.

The configuration of FIG. 12 allows a single coaxial cable or other transmission line path to simultaneously feed both the PIFA portion and the slot portion of the hybrid PIFA/slot antenna.

Grounding point 115 functions as the ground terminal for the slot antenna portion of the hybrid PIFA/slot antenna that is formed by slot 70 in ground plane 54-2. Point 106 serves as the signal terminal for the slot antenna portion of the hybrid PIFA/slot antenna. Signals are fed to point 106 via the path formed by conductive path 112, tuning element 114, path 117, and path 104.

For the PIFA portion of the hybrid PIFA/slot antenna, point 115 serves as antenna ground. Center conductor 108 and its attachment point to conductor 112 serve as the signal terminal for the PIFA. Conductor 112 serves as a feed conductor and feeds signals from signal terminal 108 to PIFA resonating element 54-1.

In operation, both the PIFA portion and slot antenna portion of the hybrid PIFA/slot antenna contribute to the performance of the hybrid PIFA/slot antenna.

The PIFA functions of the hybrid PIFA/slot antenna are obtained by using point 115 as the PIFA ground terminal (as with terminal 62 of FIG. 7), using point 108 at which the coaxial center conductor connects to conductive structure 112 as the PIFA signal terminal (as with terminal 60 of FIG. 7), and using conductive structure 112 as the PIFA feed conductor (as with feed conductor 58 of FIG. 7). During operation, antenna conductor 112 serves to route radio-frequency signals from terminal 108 to resonating element 54-1A in the same way that conductor 58 routes radio-frequency signal from terminal 60 to resonating element 54-1A in FIGS. 4 and 5, whereas conductive line 104 serves to terminate the resonating element 54-1 to ground plane 54-2, as with grounding portion 61 of FIGS. 4 and 5.

The slot antenna functions of the hybrid PIFA/slot antenna are obtained by using grounding point 115 as the slot antenna ground terminal (as with terminal 86 of FIG. 8), using the conductive path formed of antenna conductor 112, tuning element 114, antenna conductor 117, and antenna conductor 104 as conductor 82 of FIG. 8 or conductor 82-2 of FIG. 10, and by using terminal 106 as the slot antenna signal terminal (as with terminal 84 of FIG. 8).

The illustrative configuration of FIG. 10 demonstrates how slot antenna ground terminal 92 and PIFA antenna ground terminal 88 may be formed at separate locations on ground plane 54-2. In the configuration of FIG. 12, a single coaxial cable may be used to feed both the PIFA portion of the antenna and the slot portion of the hybrid PIFA/slot antenna. This is because terminal 115 serves as both a PIFA ground terminal for the PIFA portion of the hybrid antenna and a slot antenna ground terminal for the slot antenna portion of the hybrid antenna. Because the ground terminals of the PIFA and slot antenna portions of the hybrid antenna are provided by a common ground terminal structure and because conductive paths 112, 117, and 104 serve to distribute radio-frequency signals to and from the resonating element 54-1A and ground plane 54-2 as needed for PIFA and slot antenna operations, a single transmission line (e.g., coaxial conductor 56) may be used to send and receive radio-frequency signals that are transmitted and received using both the PIFA and slot portions of the hybrid PIFA/slot antenna.

If desired, other antenna configurations may be used that support hybrid PIFA/slot operation. For example, the radio-frequency tuning capabilities of tuning capacitor 114 may be provided by a network of other suitable tuning components, such as one or more inductors, one or more resistors, direct shorting metal strip(s), capacitors, or combinations of such components. One or more tuning networks may also be connected to the hybrid antenna at different locations in the antenna structure. These configurations may be used with single-feed and multiple-feed transmission line arrangements.

Moreover, the location of the signal terminal and ground terminal in the hybrid PIFA/slot antenna may be different from that shown in FIG. 12. For example, terminals 115/108 and terminal 106 can be moved relative to the locations shown in FIG. 12, provided that the connecting conductors 112, 117, and 104 are suitably modified.

The PIFA portion of the hybrid PIFA/slot antenna can be provided using a substantially F-shaped conductive element having one or more arms such as arms 98 and 100 of FIG. 12 or using other arrangements (e.g., arms that are straight, serpentine, curved, have 90° bends, have 180° bends, etc.). The strip antenna formed with resonating element 54-1B can also be formed from conductors of other shapes. Use of different shapes for the arms or other portions of resonating elements 54-1A and 54-1B helps antenna designers to tailor the frequency response of antenna 54 to its desired frequencies of operation and maximize isolation. The sizes of the structures in resonating elements 54-1A and 54-1B can be adjusted as needed (e.g., to increase or decrease gain and/or bandwidth for a particular operating band, to improve isolation at a particular frequency, etc.).

The foregoing is merely illustrative of the principles of this invention and various modifications can be made by those skilled in the art without departing from the scope and spirit of the invention.

What is claimed is:

1. A wireless handheld electronic device comprising:

storage that stores data;

processing circuitry coupled to the storage that generates data for wireless transmission and that processes wirelessly received data; and wireless communications circuitry, wherein the wireless communications circuitry comprises:

transceiver circuitry;

first and second antennas; and first and second transmission lines, wherein the first transmission line has a ground conductor and has a signal conductor and conveys radio-frequency signals for the first antenna between the transceiver circuitry and the first antenna, wherein the second transmission line has a ground conductor and has a signal conductor and conveys radio-frequency signals for the second antenna between the transceiver circuitry and the second antenna, wherein the first antenna operates in a first frequency range and a second frequency range, wherein the second antenna operates in a third frequency range that is different than the first and second frequency ranges, wherein the first antenna comprises a planar ground element with a dielectric-filled slot and a planar resonating element located above the slot, and wherein the planar resonating element comprises an antenna isolation element that resonates in the third frequency range and isolates the first antenna and the second antenna in the third frequency range.

2. The wireless handheld electronic device defined in claim 1 further comprising a rectangular housing having an end, wherein the first antenna comprises a hybrid planar-inverted-F and slot antenna and is located with the second antenna at the end of the rectangular housing.

3. The wireless handheld electronic device defined in claim 1 wherein the planar resonating element comprises a first arm that serves as the antenna isolation element and a second arm that resonates in a common frequency range with the slot.

4. The wireless handheld electronic device defined in claim 1 wherein the planar resonating element comprises:

a first arm that is folded back on itself and that serves as the antenna isolation element; and a second arm that is folded back on itself, wherein the wireless handheld electronic device further comprises a plastic cap that covers the first and second antennas.

5. The wireless handheld electronic device defined in claim 1 wherein the planar resonating element comprises a first arm that serves as the antenna isolation element and a second arm that resonates in a common frequency range with the slot and wherein the dielectric filled slot comprises a rectangular slot filled with air, the wireless handheld electronic device further comprising a housing that is formed at least partly from metal and that serves as an antenna ground element for the first and second antennas.

6. First and second antennas for use in a handheld device that has a substantially rectangular housing with lateral dimensions, comprising:

a substantially rectangular ground plane antenna element having lateral dimensions substantially equal to the lateral dimensions of the housing, wherein the ground plane antenna element serves as ground for the first and second antennas;

a first planar antenna resonating element associated with the first antenna and a second planar antenna resonating element associated with the second antenna, wherein the first antenna operates in a first frequency range and a second frequency range, wherein the second antenna operates in a third frequency range that is different than the first and second frequency ranges; and an antenna isolation element that resonates in the third frequency range and that isolates the first antenna and the second antenna in the third frequency range.

7. The antennas defined in claim 6 wherein the antenna isolation element is associated with the first antenna and wherein the first planar antenna resonating element has at least one arm.

8. The antennas defined in claim 6 wherein the first planar antenna resonating element has a first arm that serves as the isolation element and has a second arm that is longer than the first arm and wherein the isolation element comprises a strip of metal formed on a flex circuit.

9. The antennas defined in claim 6 wherein the first planar antenna resonating element has a first arm that serves as the isolation element and has a second arm that is longer than the first arm.

10. The antennas defined in claim 6 wherein the isolation element comprises a strip of metal formed on a flex circuit.

* * * * *

UNITED STATES PATENT AND TRADEMARK OFFICE

CERTIFICATE OF CORRECTION

PATENT NO. : 7,898,485 B2
APPLICATION NO. : 12/504443
DATED : March 1, 2011
INVENTOR(S) : Robert W. Schlub et al.

It is certified that error appears in the above-identified patent and that said Letters Patent is hereby corrected as shown below:

On page 2, in column 2, under "Foreign Patent Documents", line 4, delete "2005/019567" and insert -- 2005/109567 --, therefor.

In column 7, line 63, delete "phonolic" and insert -- phenolic --, therefor.

Signed and Sealed this
Fifteenth Day of November, 2011

David J. Kappos

David J. Kappos
*Director of the United States Patent and Trademark Office*